United States Patent [19]

Roselius et al.

[11] 4,036,735

[45] July 19, 1977

[54] PROCESS FOR UPGRADING MOTOR GASOLINE

[75] Inventors: Ronald R. Roselius, Richmond; Alexander G. Edeleanu, Moraga, both of Calif.

[73] Assignee: Chevron Research Company, San Francisco, Calif.

[21] Appl. No.: 347,100

[22] Filed: Apr. 2, 1973

[51] Int. Cl.[2] ..... C10G 39/00

[52] U.S. Cl. ..... 208/89; 208/66

[58] Field of Search ..... 208/89, 66

[56] References Cited

U.S. PATENT DOCUMENTS

| | | | |
|---|---|---|---|
| 2,800,428 | 7/1957 | Hengstebeck | 208/89 |
| 3,009,789 | 11/1961 | Jordan et al. | 44/52 |
| 3,050,458 | 8/1962 | van't Spijker | 208/89 |
| 3,384,576 | 5/1968 | Greco | 208/89 |
| 3,395,094 | 7/1968 | Weisz | 208/62 |
| 3,556,986 | 1/1971 | Beck et al. | 208/89 |

OTHER PUBLICATIONS

Guthrie, V. B., *Petroleum Products Handbook*, 1960, pp. 4–26 to 4–27.

*Primary Examiner*—Delbert E. Gantz
*Assistant Examiner*—James W. Hellwege
*Attorney, Agent, or Firm*—J. A. Buchanan, Jr.; D. A. Newell; R. H. Davies

[57] ABSTRACT

A process is disclosed wherein a naphtha feedstock is subjected to hydrotreating, a $C_5$+ fraction from the hydrotreating zone effluent is catalytically reformed in a reforming zone with the reformate being subjected to selective catalytic hydrocracking to produce $C_4$+ liquid fraction. The liquid fraction is then admixed with a portion of $C_4$ hydrocarbons obtained from the hydrotreating zone effluent.

9 Claims, 1 Drawing Figure

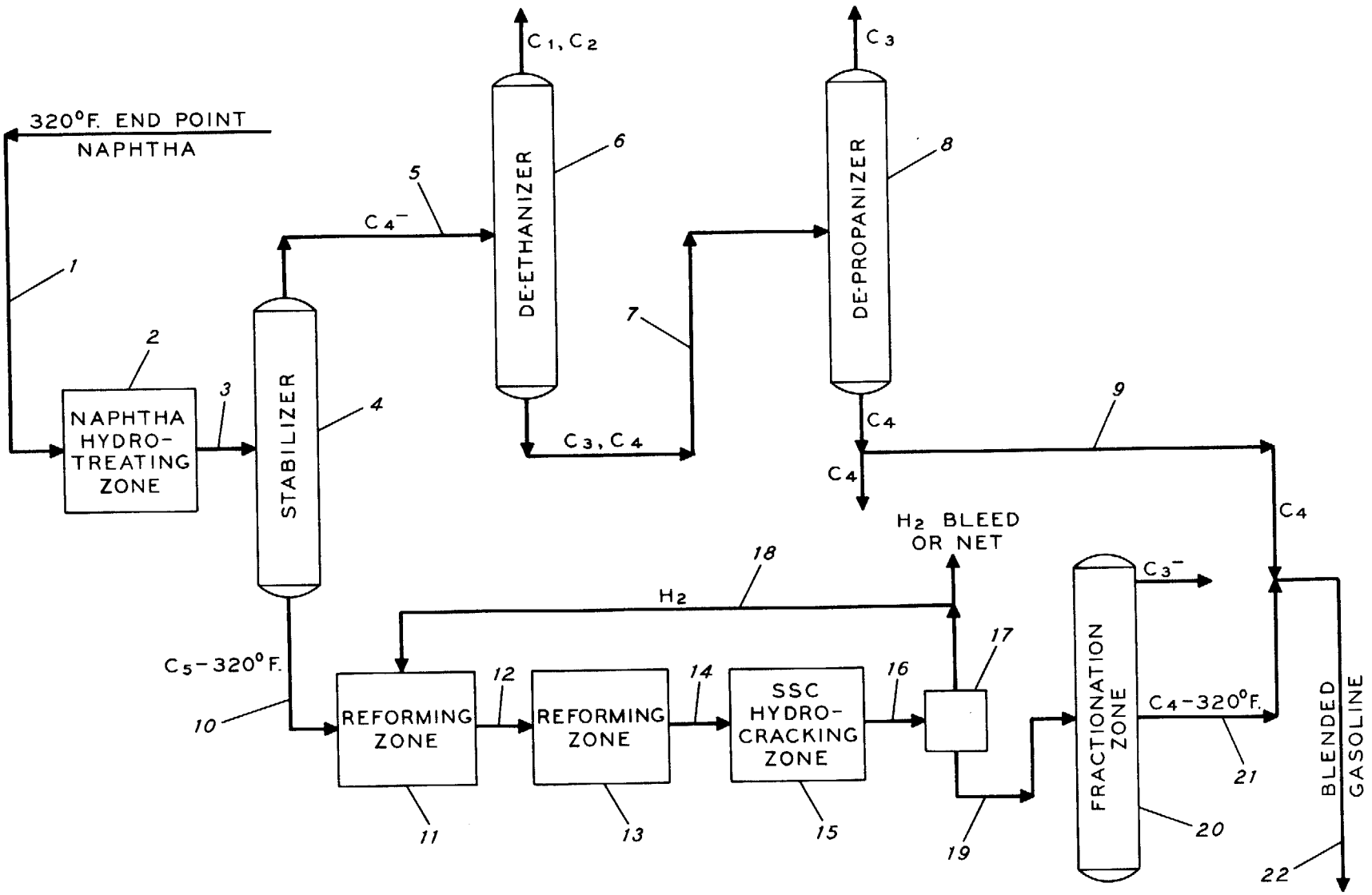
320°F. END POINT NAPHTHA
1
NAPHTHA HYDRO-TREATING ZONE
2
3
STABILIZER
4
C4⁻
5
DE-ETHANIZER
6
C1, C2
7
C3, C4
DE-PROPANIZER
8
C3
C4
9
C4
C5-320°F.
10
REFORMING ZONE
11
12
REFORMING ZONE
13
14
SSC HYDRO-CRACKING ZONE
15
16
17
H2 BLEED OR NET
18
H2
19
FRACTIONATION ZONE
20
C3⁻
C4-320°F.
21
BLENDED GASOLINE
22

PROCESS FOR UPGRADING MOTOR GASOLINE

BACKGROUND OF THE INVENTION

1. Field of the Invention

As lead additives are removed from gasoline, there is a continuing need for higher octane gasoline blending components. A primary means of obtaining these higher octane gasoline components is catalytic reforming. Catalytic reforming has undergone dramatic improvements in octane capability, operating efficiency, and selectivity in yield and product quality in the past six years. However, to meet the increasingly rigorous specifications for gasoline, in an economic and efficient manner, new approaches are required.

This invention is directed to a process whereby the increasingly rigorous quality specifications for gasoline, inter alia, octane numbers, volatility, specific gravity, aromatics content, lead antiknock compound content, can be met. Further, the gasoline produced meets all the general requirements associated with providing for satisfactory engine performance, particularly those requirements necessary for proper performance of (1) highcompression engines, and (2) engines whose design induces at certain times incomplete fuel vaporization and subsequent unequal distribution of fuel components to all combustion chambers. These general requirements for gasoline quality are well known to those skilled in the practice of refining naphthas to produce high quality gasolines. Of current and future concern, especially to refiners in Europe and Japan and increasingly to U.S. gasoline producers, are those additional aforementioned requirements which include, but are not limited to, high front end octane number, minimum density or specific gravity, and minimum percent evaporated or distilled at temperatures of 200° F. to 225° F. Typical of premium grade gasoline specifications to meet these additional requirements are:

1. R-100 O.N. (front end octane number) — 89.0 to 91.0 minimum
2. Specific gravity — 0.745 to 0.750 minimum
3. Volume percent distilled at 212° F. — 44 to 50 percent minimum;

in conjunction with general specifications of:

Research octane number — 97 to 99 minimum
Motor octane number — 86 to 90 minimum
Aromatics content, volume percent — 45 to 52 maximum
Lead content, gm Pb/U.S. Gal. — 0 to 2.0 maximum.

While typical of specifications for premium grade gasolines, these values should not be construed as limiting since more or less severe specifications may be set up dependent on a variety of factors.

To meet the above specifications (1), (2) and (3) requires processing to upgrade the octanes of the $C_5$—$C_6$—$C_7$ components of naphthas, preferably the $C_6$-$C_7$ components, and more preferably the $C_7$ components. Correspondingly the processing may provide a degree of upgrading by removal of the lowest octane components by conversion to lighter-than-gasoline materials, e.g., propane, which results in a higher octane number gasoline. It is common practice to upgrade octanes of $C_5$—$C_6$—$C_7$ components by isomerization, reforming, separation by distillation or extraction, and various other well known processing steps sequentially and in various combinations. The complexity and cost of these combinations increase in proportion to the required overall octane upgrading. It is the purpose of this invention to provide a simple, direct and economical process for producing gasoline meeting all of the aforesaid quality requirements, and especially and uniquely maximizing the octanes of the $C_5$—$C_6$—$C_7$ portions of gasoline while yielding the correct proportions of $C_5$—$C_6$—$C_7$ to satisfy specific gravity and volatility requirements.

DESCRIPTION OF THE PRIOR ART

Numerous patents have issued directed to selective conversion of normal paraffins. For example, U.S. Pat. No. 3,395,094 discloses a process for reforming a naphtha hydrocarbon fraction followed by contacting the reformate with a shape selective zeolite to permit the selective conversion of the normal paraffins to saturated lower boiling products thereby obtaining a naphtha fraction with an octane number above 100.

Other representative patents include U.S. Pat. Nos. 3,140,322, 3,267,023, 3,344,058, 3,379,640, 3,579,434, 3,594,311, 3,192,150, 3,544,451, 3,617,492, and 3,625,880.

SUMMARY OF THE INVENTION

The present invention is directed to a process for producing high quality gasoline characterized by the steps comprising:

1. contacting a naphtha feedstock together with hydrogen in a hydrotreating zone at hydrotreating conditions, with a hydrotreating catalyst thereby obtaining a hydrocarbon effluent;
2. separating the hydrocarbon effluent into
   a. a first fraction comprising $C_4$ - hydrocarbons, and preferably $iC_5$, and
   b. a second fraction comprising $C_5$ + hydrocarbons:
3. contacting at least a portion of the second fraction together with hydrogen in a reforming zone at reforming conditions with a reforming catalyst thereby obtaining a reformate;
4. contacting at least a portion of the reformate and hydrogen in a hydrocracking zone at hydrocracking conditions with a molecular-shape selective hydrocracking catalyst thereby obtaining a hydrocracking zone effluent comprising a normally gaseous hydrocarbon product and a $C_4$ + normally liquid product; and
5. blending at least the $C_5$ + portion of said $C_4$ + normally liquid product with at least a portion of $C_4$ hydrocarbons, and preferably $iC_5$, from said first fraction to obtain a blended gasoline.

Preferably the reforming catalyst comprises platinum and rhenium composited with alumina. The shape selective cracking hydrotreating catalyst preferably comprises erionite containing a Group VIII hydrogenation-dehydrogenation component, preferably palladium or nickel.

DETAILED DESCRIPTION OF THE INVENTION

Drawing

The drawing is a diagrammatic illustration of apparatus and flow paths suitable for carrying out one embodiment of the process of the present invention.

STATEMENT OF THE INVENTION

In accordance with the present invention there is provided an integrated, efficient process for manufacturing high quality gasoline meeting the specifications described above.

The process comprises the steps set forth in the "SUMMARY OF THE INVENTION". The feedstocks, operating conditions, catalysts used and operation of the process including modifications, will be described in detail hereinafter.

As an alternative to steps (3) and (4) set forth in the "SUMMARY OF THE INVENTION," the second fraction referred to in step (2) may be contacted with hydrogen in a reaction zone at reforming conditions (with the temperature range limited to 600° to 1000° F.) with a catalyst admixture which comprises (1) a reforming catalyst, and (2) a molecular shape selective hydrocracking catalyst thereby obtaining an effluent comprising a normally gaseous hydrocarbon product and a $C_4$ + normally liquid product. At least the $C_5$ + portion of said liquid product is then blended with at least a portion of $C_4$ hydrocarbons, and preferably $iC_5$, from the first fraction referred to in step (2).

HYDROCARBON FEEDSTOCK TO THE HYDROTREATING ZONE

The hydrocarbon feedstocks to the hydrotreating zone are naphtha feedstocks comprising hydrocarbons boiling in the range of $C_4$ to about 350° F. Minor amounts of lighter, e.g., $C_2$ and $C_3$ hydrocarbons and heavier hydrocarbons may also be present. However, the major portion of the hydrocarbon feedstock to the hydrotreating zone will boil in the range of $C_5$ to about 320° F.

OPERATING CONDITIONS IN THE HYDROTREATING ZONE

The operating conditions in the hydrotreating zone are those conventionally used in hydrotreating light naphtha-type feedstocks. These conditions will generally include a temperature from about 500 to 950° F., a pressure in the range of from 10 to 2500 psig, preferably 10 to 1200 psig, a liquid hourly space velocity (LHSV) of from 0.1 to 20, and a hydrogen supply rate in the range of from 10 to 5000, preferably 10 to 2500, SCF/barrel hydrocarbon feedstock.

The hydrotreating catalysts used in the hydrotreating zone are those conventionally used in hydrotreating of light hydrocarbon feedstocks. These include cobalt, molybdenum, nickel on an alumina or alumina/silica support. Various other known hydrotreating catalyst compositions may also be used.

The effluent from the hydrotreating zone has a reduced sulfur and nitrogen content preferably (all parts by weight) below 10 ppm sulfur and 10 ppm nitrogen, more preferably below 5 ppm sulfur and 5 ppm nitrogen, most preferably less than 1 ppm of each, and a reduced content of heavy metals known to be harmful to the activity and effectiveness of catalysts used in reforming, hydrogenation and dehydrogenation.

OPERATING CONDITIONS IN THE REFORMING ZONE(S)

Operating conditions in the reforming zone(s) will include a temperature in the range of from about 600° to 1100° F., preferably 700° to 1050° F., and most preferably 850 to 970° F., a pressure ranging from atmospheric to about 1,000 psig, preferably 25 to 1,000 psig, and more preferably from 50 to 750 psig. The LHSV will be in the range from 0.1 to 10, and preferably from 1 to 5, and the mol ratio of hydrogen to hydrocarbon in the reforming zone(s) will be in the range of 0.5/1 to 25/1. The reforming process step of the subject invention will result in the production of hydrogen. Hence, excess hydrogen need not necessarily be added to the reforming system. However, it is usually preferred to introduce excess hydrogen at some stage during the operation, as, for example, during startup. It should also be understood that a single zone or multiple reforming zones may be used.

REFORMING CATALYSTS

Reforming catalysts used in the subject invention include those conventionally used for reforming, e.g., a noble metal composited with a support such as alumina. Particularly preferred reforming catalysts are those of the type described in U.S. Pat. No. 3,415,737, the disclosure of which is incorporated herein by reference. These are bimetallic catalysts containing from 0.1 to 3 weight percent platinum, and from 0.01 to 5 weight percent rhenium composited with a porous solid catalyst support, preferably alumina.

OPERATING CONDITIONS IN THE SHAPE SELECTIVE HYDROCRACKING ZONE

The molecular-shape selective hydrocracking zone can be operated at temperatures ranging from about 500° to about 1000° F., pressures ranging from atmospheric up to about 5,000 psig, an LHSV in the range from 0.1 to about 40, and with a hydrogen supply rate (makeup and recycle) of from about 10 to about 5000, preferably 10 to about 2000, SCF/barrel of hydrocarbon feed. The shape selective cracking zone can be within a reforming reactor or may be in a separate reactor. Since it is preferred to operate the shape selective cracking zone at somewhat lower temperatures than are optimum for reforming, it is preferred that the shape selective cracking zone be in a separate reactor. More preferred conditions include a temperature range of 750°-940° F., pressure range of 200 to 800 psig, an LHSV range of 1 to 6, and a hydrogen supply rate of 30 to 250 SCF/barrel of hydrocarbon feedstock.

SHAPE SELECTIVE CRACKING CATALYST

The catalysts used in a shape selective hydrocracking zone include crystalline aluminosilicate hydrocracking catalysts of the type described in U.S. Pat. No. 3,395,094, the disclosure of which is incorporated herein by reference. These selective hydrocracking catalysts are porous solid particle materials having the majority of their pores of substantially uniform small dimension, large enough to allow uptake and egress of normal paraffin molecules, such as, for example, n-hexane, but too small to allow a similar uptake of branched chain or cyclic hydrocarbons, e.g., dimethyl butane, methylpentane, cyclohexane or benzene.

A substantial majority of the selective catalytic material used in the shape selective hydrocracking zone is highly porous material wherein a substantial majority of the pores are of a uniform dimension in the range of from about 3.0 to about 6.0 A. units effective diameter. The catalyst has in-pore acid activity cracking sites and in-pore catalytically effective hydrogenationdehydrogenation sites. The hydrogenation-dehydrogenation component introduced during manufacture of the catalyst, involves one or more of the elements known as the transition metals, as the metal, the oxide or the sulfide, or as combinations thereof. Preferably, one or more of the elements of nickel, cobalt, molybdenum, iron, or of the palladium family are utilized. Tungsten may also be utilized. The hydrogenation-dehydrogenation component can be incorporated in the aluminosilicate mineral by conventional means including ion exchange, impregnation, etc. The amount of the hydrogenation-dehydrogenation component will generally be in the range of 0.1 to about 25 weight percent, preferably about 2 to about 10 weight percent. When a noble metal is used, it is present as about 0.1 to 6 weight percent, more preferably 0.5 to 3 weight percent. When a non-noble Group VIII hydrogenating-dehydrogenating component is used, it will preferably be present in an amount of 2 to 5 weight percent. Typical of the aluminosilicate minerals which may be used in the subject invention are those known to occur naturally, such as chabazite, gmelinite, stilbite, erionite, offretite, epistilbite, and zeolites S, T, A, ZK-4, ZK-5, and others. Erionite is preferred.

Definitions

The term "$C_x$ - " where $x$ equals 3, 4, etc., when used herein, means hydrocarbons having x or less carbon atoms per molecule. Similarly, "$C_x$ + " where $x$ equals 4, 5, etc. means hydrocarbons having x or more carbon atoms per molecule.

PROCESS OPERATION WITH REFERENCE TO THE DRAWING

Referring now to the Drawing, which represents a preferred embodiment of the present invention, a 320° F. end point naphtha feedstock is fed by line 1 to naphtha hydrotreating zone 2 wherein it is contacted with naphtha hydrotreating catalyst at hydrotreating conditions. The effluent from zone 2 is sent via line 3 to stabilizer 4 wherein $C_4$— material (preferably with some $iC_5$) is removed and sent overhead by line 5 to a deethanizer 6. $C_2$ and lighter materials are taken off the top of deethanizer 6 and $C_3$ and $C_4$ (preferably with some $iC_5$) materials are taken off by line 7 and sent to the depropanizer 8 wherein $C_3$ materials are taken off overhead and the $C_4$ and $iC_5$ hydrocarbons containing substantially no $C_3$ and lighter hydrocarbons are moved via line 9. The $C_5$ to 320° F. boiling range material is removed from stabilizer 4 and sent via line 10 to reforming zone 11 wherein it is contacted with hydrogen and a reforming catalyst at reformimg conditions. The effluent from reforming zone 11 is sent via line 12 to reforming zone 13 where additional reforming is carried out. The effluent from the reforming zone 13 is sent via line 14 to shape selective hydrocracking zone 15 wherein normal paraffins are selectively hydrocracked to $C_4$ - hydrocarbons. The effluent from shape selective hydrocracking zone 15 is sent via line 16 to a separator 17 wherein hydrogen is removed and recycled to reforming zone 11 via line 18. Excess hydrogen formed in the reformers can be removed as indicated in the drawing. The hydrocarbon effluent is sent via line 19 to fractionation column 20 wherein $C_3$ - gases are removed for utilization as LPG. The $C_4$ + material is removed via line 21 and blended with at least a portion of $C_4$ or $C_4$ and $iC_5$ hydrocarbons from depropanizer 8 (line 9) to form a blended gasoline product which goes to storage via line 22.

Various modifications can be made within the scope of the subject invention. For example, the shape selective hydrocracking zone can be encompassed within a reactor in which reforming is being carried out, i.e., reforming zones 11 and 13 and shape selective cracking zone 15 may be combined in a single reaction zone. However, the shape selective cracking zone is preferably operated at lower temperatures than the reforming zone and it is therefore preferred that shape selective cracking be carried on in a separate reactor. A hydrogen quench or interzone heat exchange can also be used to control the temperature in the shape selective hydrocracking zone.

EXAMPLE

A high-quality premium grade gasoline having the specifications set forth in Table 1 below is prepared by hydrotreating a $C_4$-320° F. end point naphtha from Arabian Light Export Crude at conditions to yield an effluent containing less than 1 ppm by weight sulfur and 1 ppm by weight nitrogen. The effluent from the hydrotreating step is fed to a stabilizer where $C_4$ - material is taken off overhead together with about 50 volume percent of the iso $C_5$ present in the hydrotreating zone effluent. The $C_5$- 320° F. hydrotreated product is sent to a reforming zone operating at a pressure of about 450 psig, a 6/1 hydrogen to hydrocarbon mol ratio, a temperature of 910°-990° F., and an LHSV of 2.0. The catalyst is 0.3 weight percent Pt - 0.3 weight percent Re on a porous alumina support.

The effluent from the reforming zone is sent to a shape selective hydrocracking zone operating at about 450 psig, a 2/1 hydrogen to hydrocarbon mol ratio, 800–900° F., and an LHSV of 3.0. The catalyst is nickel combined with erionite.

The $C_4$- 320° F. portion of the effluent from the shape selective hydrocracking zone is blended with the $iC_5$ and a portion of the $C_4$ taken overhead in the stabilizer at a volume ratio of about 90% $C_4$-320° F. product to 10% $C_4$, $iC_5$ overhead to obtain the premiun grade gasolines of Table 1 having Reid vapor pressures of 10 pounds.

TABLE 1

HIGH-QUALITY GASOLINE PRODUCTION
[PREMIUM GRADE] (1)

| | | INVENTION EXAMPLES | | |
|---|---|---|---|---|
| | Typical Specifications | A | B | C |
| Lead Content g Pb/USG | 0–2.0 | 1.5 | 0.5 | 0.0 |
| R-100 O.N. (Research ON of lighter portion of the gasoline boiling at 100° C. or below) | 89–one Min. | 94.9 | 89.7 | 89.0 |
| Specific Gravity | 0.745–0.750 Min. | 0.750 | 0.755 | 0.763 |
| Vol. % Distilled at 212° F. | 44–50 Min. | 54 | 56 | 57 |
| Research O.N. | 97–99 Min. | 99.9 | 98.5 | 99.6 |
| Motor O.N. | 86–90 Min. | 92.6 | 91.6 | 91.5 |

(1) At 10 lbs. Reid vapor pressure obtained by blending $C_4$ and iso $C_5$ from line 9 in the drawing with $C_4$-320° F. product from line 21 in a ratio of about on part by volume $C_4$ and iso $C_5$ overhead to nine parts by volume $C_4$-320° F. product.

As can be seen from Table 1, the gasolines produced by the process of this invention are of high quality meeting the rigorous specifications set forth in the Table.

A further modification can be made to accommodate a feedstock naphtha containing relatively small amounts of $C_5$–$C_6$ materials, e.g., less than 20 volume percent of such $C_5$–$C_6$. For example, the overhead from stabilizer 4 sent to deethanizer 6 via line 5 may include a substantial portion (0 to 90 volume percent) of the isopentane contained in the liquid product 3 from hydrotreating zone 2. Such isopentane will be returned and blended into gasoline along with $C_4$ material via line 9, as outlined above. The feed to reforming zone 11 would then contain a proportionately decreased volume of $C_5$ materials. The net effect of this modification is the conservation of the high octane isopentane for blending into gasoline. A further modification could include additional distillation steps between stabilizer 4 and reforming zone 11 to accomplish separation of high octane isopentane ($iC_5$) and isohexanes ($iC_6$s) from the feed to zone 11 and subsequent blending of said $iC_5$ and $iC_6$ into the final gasoline blend.

Additionally, the $C_3$ obtained in the depropanizer 8 may be combined with the $C_3$ from fractionation column 19 to form valuable LPG.

Further modifications include (1) a single reforming zone be utilized ahead of the shape selective hydrocracking zone, (2) a shape selective hydrocracking zone used ahead of the reforming zone(s), and (3) the addition of feed from an external source to the shape selective hydrocracking zone in addition to the reformate which is fed to the shape selective hydrocracking zone.

It is apparent that many widely different embodiments of the present invention may be made without departing from the scope and spirit thereof. Therefore, the invention is not intended to be limited except as indicated in the appended claims.

What is claimed is:

1. A process for producing high quality gasoline from a naphtha feedstock comprising:

1. contacting said feedstock together with hydrogen in a hydrotreating zone at hydrotreating conditions, with a hydrotreating catalyst, thereby obtaining a hydrocarbon effluent;
2. separating said hydrocarbon effluent into
   a. a first fraction comprising $C_4$ – hydrocarbons, and
   b. a second fraction comprising $C_5$ + hydrocarbons;
3. contacting at least a portion of said second fraction and hydrogen in a reforming zone at reforming conditions, with a reforming catalyst, thereby obtaining a reformate;
4. contacting at least a portion of said reformate and hydrogen in a hydrocracking zone at hydrocracking conditions with a shape selective hydrocracking catalyst, thereby obtaining a hydrocracking zone effluent comprising a normally gaseous hydrocarbon product and a $C_4$ + normally liquid product; and
5. blending at least the $C_5$ + portion of said $C_4$ + normally liquid product and at least a portion of $C_4$ hydrocarbons from said first fraction to obtain said high quality gasoline.

2. The process of claim 1 wherein said feedstock comprises hydrocarbons boiling in the range of $C_4$ to about 350° F.

3. The process of claim 1 wherein said first fraction further comprises $iC_5$ and at least the $C_5$ + portion of said $C_4$ + normally liquid product is blended with (a) at least a portion of $C_4$ hydrocarbons from said first fraction, and (b) said $iC_5$ from said first fraction to obtain said high quality gasoline.

4. The process of claim 3 wherein said reforming catalyst comprises 0.1 to 3 weight percent platinum and 0.01 to 5 weight percent rhenium composited with alumina, said shape selective hydrocracking catalyst comprises erionite composited with an inpore catalytically effective hydrogenation-dehydrogenation component.

5. The process of claim 4 wherein said hydrogenation-dehydrogenation component is nickel.

6. The process of claim 5 wherein said high quality gasoline meets the following specifications:

Lead Content g Pb/USG; 0–2.0
R-100 O.N.; 89–91 Min.
Specific Gravity; 0.745–0.750 Min.
Vol. % Distilled at 212° F.; 44–50 Min.
Research O.N.; 97–99 Min.
Motor O.N.; 86–90 Min.

7. A process for producing high quality gasoline from a naphtha feedstock comprising:

1. contacting said feedstock together with hydrogen in a hydrotreating zone at hydrotreating conditions, with a hydrotreating catalyst, thereby obtaining a hydrocarbon effluent;
2. separating said hydrocarbon effluent into
   a. a first fraction comprising $C_4$ – hydrocarbons, and
   b. a second fraction comprising $C_5$ + hydrocarbons;
3. contacting at least a portion of said second fraction and hydrogen in a reaction zone at reforming conditions, including a temperature of from 600° to 1000° F., with a catalyst which comprises in admixture (1) a reforming catalyst, and (2) a molecular shape selective hydrocracking catalyst, thereby obtaining an effluent comprising normally gaseous hydrocarbon product and a $C_4$+ normally liquid product; and
4. blending at least the $C_5$ + portion of said $C_4$ + normally liquid product and at least a portion of $C_4$ hydrocarbons from said first fraction to obtain said high quality gasoline.

8. The process of claim 7 wherein said feedstock comprises hydrocarbons boiling in the range of $C_4$ to about 350° F.

9. The process of claim 7 wherein said first fraction further comprises $iC_5$ and at least the $C_5$ + portion of said $C_4$ + normally liquid product is blended with (a) at least a portion of $C_4$ hydrocarbons from said first fraction, and (b) said $iC_5$ from said first fraction to obtain said high quality gasoline.

* * * * *